US007161462B2

(12) United States Patent
Tierney et al.

(10) Patent No.: US 7,161,462 B2
(45) Date of Patent: Jan. 9, 2007

(54) GAS PERMEABLE RESISTOR CASING

(75) Inventors: Brian M. Tierney, Newfane, NY (US); Gary G. Innocenti, Clarence Center, NY (US)

(73) Assignee: Kanthal Corporation, Niagara Falls, NY (US)

( * ) Notice: Subject to any disclaimer, the term of this patent is extended or adjusted under 35 U.S.C. 154(b) by 0 days.

(21) Appl. No.: 10/751,473

(22) Filed: Jan. 6, 2004

(65) Prior Publication Data

US 2005/0146412 A1 Jul. 7, 2005

(51) Int. Cl.
*H01C 1/026* (2006.01)

(52) U.S. Cl. ..... 338/234; 338/259; 338/276

(58) Field of Classification Search ..... 338/234, 338/236, 259, 273, 274, 276, 21, 22 R, 113
See application file for complete search history.

(56) References Cited

U.S. PATENT DOCUMENTS 1,297,472 A * 3/1919 Hynes ..... 338/57
1,473,107 A * 11/1923 Kohn ..... 338/257
2,079,369 A * 5/1937 Bradley ..... 338/259
2,084,840 A 6/1937 Ehlers
2,111,220 A 3/1938 Megow
2,357,241 A 8/1944 Wagner
2,361,405 A 10/1944 Kopple
2,558,798 A 7/1951 Thom
2,741,687 A 4/1956 Toppari
2,744,988 A 5/1956 Tierman
2,808,492 A * 10/1957 Yohe ..... 174/102 R
3,486,002 A * 12/1969 Eno et al. ..... 392/373
4,542,365 A * 9/1985 McTavish et al. ..... 338/20
4,656,555 A * 4/1987 Raudabaugh ..... 361/117
5,043,838 A * 8/1991 Sakich ..... 361/117

* cited by examiner

*Primary Examiner*—Tu Hoang
(74) *Attorney, Agent, or Firm*—Drinker Biddle & Reath LLP

(57) ABSTRACT

A resistor apparatus for containing broken pieces of an overheated resistor body is provided. The resistor apparatus includes a resistor body and a first and second lead wire electrically connected to opposite sides of the core. A gas permeable containment casing substantially encloses the resistor body and is fixed to the lead wires by fasteners, therefore maintaining the containment casing in a position substantially enclosing the resistor body. In the event that the resistor overheats and the resistor body breaks, the containment casing is maintained in a position to contain any pieces of the overheated resistor that break away, while allowing any gasses to escape, therefore preventing explosion of the containment casing and damage to surrounding apparatuses.

7 Claims, 1 Drawing Sheet

GAS PERMEABLE RESISTOR CASING

BACKGROUND OF THE INVENTION

The present invention relates generally to electric resistors, especially resistors that can break into pieces when overheated.

DESCRIPTION OF RELATED ART

Axial leaded resistors have a resistor body comprising a core and wires connected to the core. An insulating layer normally surrounds the core, but is not necessary for the operation of a leaded resistor. This insulating layer is gas impermeable meaning that the insulating layer does not allow gas to freely travel through the insulating layer, thereby allowing a pressure differential to form between opposite sides of the insulating layer. The resistor core provides electrical resistance to the current that is delivered through the lead wires. The lead wires connect to opposite ends of the body and electrically connect to the core either directly or through end caps.

Three prevalent types of resistors are: wire wound, film, and bulk. A wire wound resistor core comprises a spiral of conductive material (normally carbon based or metal) wrapped around a ceramic rod. A film resistor core comprises a film of resistive material (normally carbon based or metallic oxide film deposited through vapor deposition) formed around a ceramic rod. In contrast, a bulk resistive resistor core comprises a mixture of non-conductive ceramic material and conductive material.

During operation, electric current travels into the core through a first lead wire and out through a second lead wire. The core provides resistance to the current and creates a voltage gradient across the resistor. The byproduct of the voltage gradient is power in the form of heat. When an excessively large current is applied, the resistor body overheats thereby causing thermal shock and production of gas. Generally, thermal shock results when different areas of the resistor body (e.g. the inner and outer areas) thermally expand at different rates either due to uneven or rapid heating, or different material properties. For example, during heating of a resistor body, the inner area's temperature may rise much faster than the outer area. Therefore, the inner area will thermally expand more than the outer area thereby causing thermal shock. Thermal shock creates forces that contribute to the breaking of a resistor. Also, an extremely hot resistor core produces gas by heating any water or organic matter located inside the resistor core thereby producing gas. This gas, as well as any other pockets of gas present in the resistor core, are trapped and greatly expand thereby exerting pressure and contributing to the breaking of the resistor. If a gas impermeable insulating layer is disposed around the resistor core, it will likely break either under thermal shock or the pressure from the heated gas.

Thus, when a resistor overheats and breaks apart, resistor pieces and heated gas are propelled outward. These broken pieces can damage the surrounding apparatus or otherwise cause inconvenience. It is therefore desirable to effectively and economically contain broken pieces of overheated resistor bodies.

BRIEF SUMMARY OF THE INVENTION

The present invention fills the aforementioned needs by providing a method and apparatus for easily and economically containing any broken pieces of an overheated resistor body.

One aspect of the present invention involves a resistor apparatus comprising a first and second lead wire and a resistor body. The resistor body comprises a resistor core, a first lead wire being electrically attached to a first end of the resistor core, and a second lead wire being attached to a second end of the resistor core. A gas permeable generally tubular containment casing substantially encloses the resistor body and has sufficient tensile strength and temperature resistance to contain broken pieces of an overheated resistor body while permitting the escape of gas, thereby avoiding substantial pressure build-up within the casing.

Another aspect of the present invention involves a method for containing broken pieces of an overheated resistor body. The method comprises substantially surrounding the resistor body with a gas permeable substantially tubular containment casing having a tensile strength and temperature resistance capable of containing broken pieces of an overheated resistor body, and fixing the gas permeable containment casing to at least one lead wire connected to the resistor body. The gas permeable containment casing is thereby prevented from sliding relative to the resistor body and maintains the gas permeable containment casing in a position substantially surrounding the resistor body.

As may be appreciated, the present invention provides a method and apparatus for containing pieces of a broken overheated resistor, while allowing heated gas to escape from the resistor apparatus.

BRIEF DESCRIPTION OF THE DRAWINGS

Many advantages of the present invention will be apparent to those skilled in the art with a reading of the specification in conjunction with the attached drawings, wherein like reference numerals are applied to like elements.

DETAILED DESCRIPTION OF PREFERRED EMBODIMENTS OF THE INVENTION

A preferred embodiment of the present invention provides a resistor apparatus comprising a gas permeable containment casing and a resistor body disposed inside the casing. The resistor body comprises a resistor core surrounded by an insulating layer, and lead wires electrically connected to each end of the resistor core. As current travels through the resistor core, power is produced in the form of heat. When a large current is applied to the resistor core, the resistor body may reach extreme temperatures. During extreme heating, different areas of the resistor body are heated and thermally expand at different rates, thereby causing thermal shock. Also any gas that is present in the overheated resistor is heated and greatly expands. The gas can be either inadvertently trapped in the core during manufacture, or produced by heating organic matter. If the resistor becomes overheated, the thermal shock and pressure from expanded gasses exert forces that contribute to breaking apart the resistor body.

Upon breaking of the resistor body, the gas permeable containment casing allows any heated gas to permeate out of the resistor apparatus while containing any broken pieces of the overheated resistor body. Thus, the gas permeable containment casing withstands the extreme heat, does not explode under pressure from heated gas, and prevents broken pieces of overheated resistor body from damaging surrounding apparatus.

Figure 1:
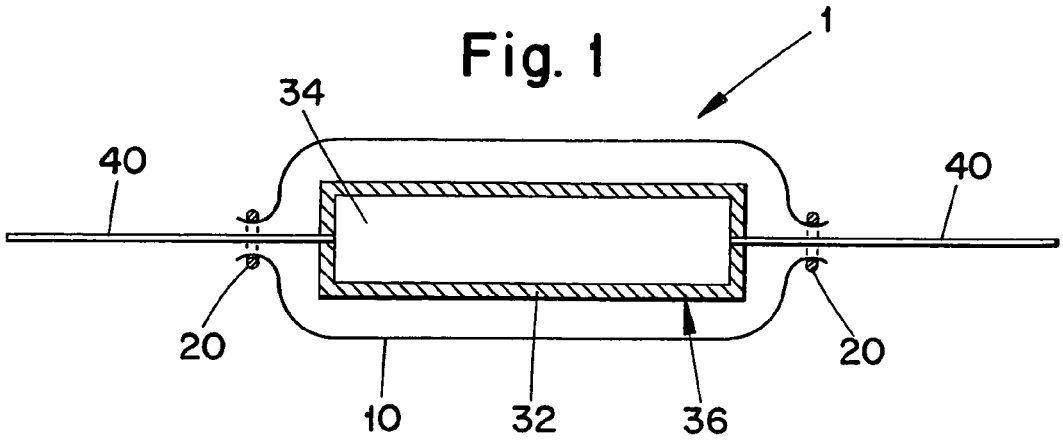
FIG. 1 illustrates a side view of a resistor apparatus having a resistor substantially enclosed by a gas permeable containment casing made of fiberglass sleeve.

Now making reference to the figures, and more particularly FIG. 1. FIG. 1 illustrates a side view of a resistor apparatus 1. The resistor apparatus 1 includes a resistor body 36 comprising a core 34 and an optional surrounding insulating layer 32. A first and second lead wire 40 of the resistor apparatus electrically connect to opposite ends of the resistor core 34. The resistor apparatus 1 also includes a gas permeable containment casing 10 substantially surrounding the resistor body 36 and being fixed to the lead wires 40 by respective fasteners 20. In a preferred embodiment, the gas permeable containment casing allows the gasses, and especially the hot gasses, to flow freely through the casing. In this particular preferred embodiment of the present invention, the gas permeable containment casing 10 is a generally tubular fiberglass sleeve and thus somewhat flexible. Though woven fiberglass is the preferred material, woven ceramic fiber or other suitable materials can be used instead. The fasteners 20 are metal clasps and fix the gas permeable containment casing 10 to the lead wires 40 so as to maintain the gas permeable containment casing 10 in a position substantially enclosing the resistor body 36.

During operation, current travels into and out of the resistor core 34 through the first and second lead wires 40 respectively. When a large current is applied to the resistor core 34, the resistor body 36 becomes extremely hot. As different components of the resistor body 36 tend to thermally expand at different rates, thermal shock results. Also, rapid heating causes different areas of the resistor to be heated and thermally expand at different rates, thereby also producing thermal shock. Further, water, moisture, or organic matter present in the overheated resistor is heated and produces gas. Gas located between the resistor body 36 and the gas permeable containment casing 10 escapes, but any gas trapped inside either the insulating layer 32 or the core 34 builds up pressure. The thermal shock and heated gasses break apart the resistor body 36, thereby propelling gas and broken parts of the resistor body 36. The gas permeable containment casing 10 allows gas to escape, therefore preventing explosion of the containment casing 10, while containing broken pieces of the resistor body 36.

The casing 10 is formed of a material such as fiberglass or ceramic fiber, that posses a tensile strength great enough to contain the broken pieces, and a sufficiently high temperature resistance to continuously function as disposed around the resistor body. Although it is preferable that the temperature resistance be at least as high as the breaking temperature of the resistor body (i.e., the temperature at which the resistor body tends to break apart), it should be noted that the containment casing 10 seldom becomes as hot as the resistor body 36. The temperature of the containment casing 10 is related to the distance between the containment casing 10 and the resistor body 36, as well as the duration of the overheated condition. Also, even if the casing 10 becomes as hot as the resistor, for a short period of time the casing 10 can withstand temperatures that eventually will destroy it. Thus, the temperature resistance of the containment casing 10 may be lower than the breaking temperature of the resistor and still operate effectively. Preferably, the casing is temperature resistant to at least 80° C. In one preferred embodiment, the fiberglass casing is temperature resistant to about 650° C., and the woven ceramic fiber casing is temperature resistant to about 1100° C.

Figure 2:
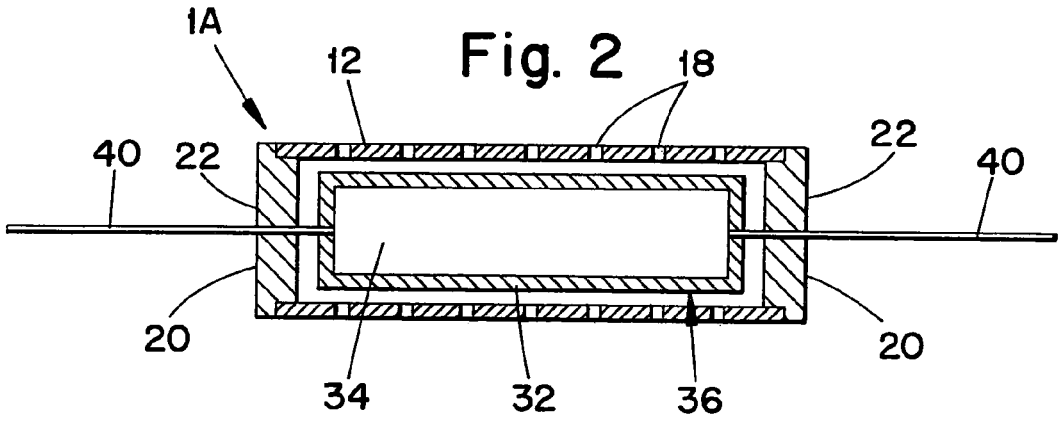
FIG. 2 illustrates a side view of a resistor apparatus having a resistor substantially enclosed by a gas permeable containment casing made of a rigid sleeve containing pores.

Now turning attention to FIG. 2, that figure illustrates an alternative embodiment of the resistor apparatus 1A wherein the gas permeable generally tubular containment casing 12 comprises a rigid casing, for example, a ceramic casing. As may be seen with reference to FIG. 2, the gas permeable rigid containment casing 12 is fixed around the lead wires 40 by fasteners 20 in the form of end caps 22. Pores 18 are provided in the rigid casing 12, thus allowing gas to permeate therethrough. The fasteners 20 in the form of end caps 22 fix the rigid casing 12 in a position substantially surrounding the resistor body 36. During operation and overheating of a resistor body 36, the preferred embodiment shown in FIG. 2 operates in a similar manner as the preferred embodiment shown in FIG. 1 to contain broken pieces of the resistor body 36.

Figure 3:
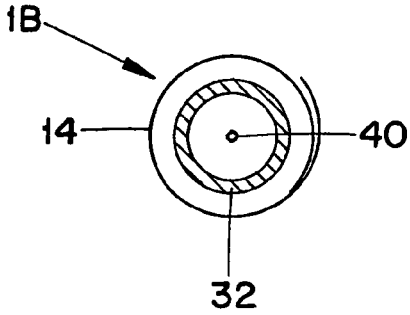
FIG. 3 illustrates an axial view of a resistor apparatus having a resistor substantially enclosed by a gas permeable containment casing made of fiberglass sheet wrapped around the resistor body.

Now turning attention to FIG. 3, FIG. 3 illustrates an alternative embodiment of the resistor apparatus 1B, where the gas permeable generally tubular containment casing 14 is made of fiberglass sheet and is wrapped around the resistor body 36, therefore substantially enclosing the resistor body 36. As noted above, woven fiberglass is preferred, but woven ceramic fibers can also be used. Fasteners 20 in the form of metal clamps fix either end of the containment casing 14 around the lead wire 40 therefore maintaining the containment casing 14 in a position substantially surrounding the resistor body 36. During operation and overheating of a resistor body, the preferred embodiment shown in FIG. 3 operates in a similar manner as the preferred embodiment shown in FIG. 1 to contain broken pieces of the resistor body 36.

The above are exemplary modes of carrying out the invention and are not intended to be limiting. It will be apparent to those of ordinary skill in the art that modifications thereto can be made without departure from the spirit and scope of the invention as set forth in the accompanying claims. For example, although metal clasps and string have been disclosed as fasteners for fixing the porous casings in place, any other suitable form of fastener could be employed. Also, the gas permeable casing could be formed of any suitable gas permeable material having sufficient tensile strength and temperature resistance to contain broken pieces of an overheated resistor body.

What is claimed is:

1. A resistor apparatus comprising:

a first lead wire and a second lead wire, and a single resistor body separate from the first and second lead wires;

the resistor body comprising a resistor core enclosed within a gas impermeable insulative layer;

the first lead wire being electrically attached to a first end of the resistor core, and the second lead wire being electrically attached to a second end of the resistor core; and a flexible gas permeable substantially tubular containment casing formed of a woven material, fixed to at least one of the first and second lead wires, substantially enclosing the resistor body and spaced from the resistor body to prevent it from sliding relative to said resistor body, wherein the tubular containment casing has sufficient tensile strength and temperature resistance to contain broken pieces of the resistor body occurred when being overheated while permitting the escape of gas thereby avoiding a substantial pressure build-up within the casing.

2. The apparatus of claim 1, wherein the casing comprises woven fiberglass.

3. The apparatus of claim 1, wherein the casing comprises woven ceramic fiber.

4. The apparatus of claim 1, wherein the temperature resistance is at least 100° C.

5. The apparatus of claim 1, wherein the temperature resistance is at least 80° C.

6. The apparatus of claim 1, further comprising fasteners for fixing respective ends of the casing to the lead wires, thereby preventing the casing from sliding relative to the resistor body.

7. The apparatus of claim 1, wherein the insulating layer is disposed directly against the resistor core.

* * * * *